United States Patent [19]

Di Nunzio et al.

[11] Patent Number: 4,969,447

[45] Date of Patent: Nov. 13, 1990

[54] INDUCTIVE-DISCHARGE IGNITION DEVICE FOR AN INTERNAL COMBUSTION ENGINE

[75] Inventors: Vittorio Di Nunzio; Riccardo Colla, both of Turin, Italy

[73] Assignee: Fiat Auto S.p.A., Turin, Italy

[21] Appl. No.: 437,808

[22] Filed: Nov. 17, 1989

[30] Foreign Application Priority Data

Nov. 22, 1988 [IT] Italy ..... 68039 A/88

[51] Int. Cl.[5] ..... F02P 3/05

[52] U.S. Cl. ..... 123/645; 123/654; 123/656

[58] Field of Search ..... 123/645, 652, 653, 654, 123/656

[56] References Cited

U.S. PATENT DOCUMENTS 4,290,406 9/1981 Iyoda et al. ..... 123/645

FOREIGN PATENT DOCUMENTS 0187528 11/1983 Japan ..... 123/645

*Primary Examiner*—Tony M. Argenbright
*Assistant Examiner*—Robert E. Mates
*Attorney, Agent, or Firm*—Shlesinger & Myers

[57] ABSTRACT

The device is of the type comprising for each engine spark plug a transformer with a secondary winding to be connected to the respective spark plug and a primary winding connected to the output of a power stage able to provide an ON-OFF signal for controlling the transformer. The device also comprises a damping network and, interposed between the network and the output of the power stage, unidirectional connection means which connect said network to the output of the power stage each time the signal present at said output switches from an OFF condition to an ON condition.

9 Claims, 1 Drawing Sheet

INDUCTIVE-DISCHARGE IGNITION DEVICE FOR AN INTERNAL COMBUSTION ENGINE

BACKGROUND OF THE INVENTION

This invention relates to a inductive-discharge ignition device for an internal combustion engine.

More particularly, the invention relates to a device of the type comprising, for each spark plug, a transformer with a secondary winding to be connected to a respective spark plug and a primary winding connected to the output of a power stage able to generate an ON-OFF signal for controlling the transformer.

The power stage is generally provided at its output with a Darlington-connected transistor the collector of which is directly connected to a terminal of said transformer primary winding, the other primary winding terminal being connected to a direct current power source such as an accumulator battery.

The operation of known devices of the aforesaid type is essentially to provide the transformer primary winding with an alternating signal by putting said power transistor alternately into a conducting and inhibited state. By this means, a high voltage is induced (especially following the inhibition of the transistor) in the transformer secondary winding of such an extent as to trigger an arc in the respective spark plug.

It has also been noted that particularly during the OFF-ON switching stage, a damped oscillating signal is superposed on the voltage induced in the secondary winding, this signal being of high frequency (depending not only on the transformer parameters but also on the switching speed) and having the amplitude of its first half-wave directly proportional to the transformation ratio (turn ratio) of the transformer and to the direct current voltage with which said power transistor and primary winding are powered. Under certain engine operating conditions said oscillating signal can trigger the arc in the spark plug, resulting in considerably misplaced spark advance.

To obviate the said drawback it is known to provide the secondary winding with a series-connected diode (with the cathode facing the winding), the purpose of which is essentially to cut the unrequired high voltage.

The aforesaid method is however particularly expensive because of the very high cost of the diode used, which has to be chosen from those able to withstand a very high inverse voltage.

SUMMARY OF THE INVENTION

The object of the present invention is to provide an ignition device which obviates the aforesaid drawbacks of known devices. Said object is attained according to the present invention by an inductive discharge ignition device for an internal combustion engine, of the type comprising for each spark plug a transformer with a secondary winding to be connected to a relative spark plug and a primary winding connected to the output of a power stage able to provide an ON-OFF signal for controlling said transformer, characterised by comprising a damping network and, interposed between said network and the output of said power stage, unidirectional connection means which connect said network to the output of said stage each time the signal present at said output switches from an OFF condition to an ON condition.

BRIEF DESCRIPTION OF THE DRAWINGS

The invention will be more apparent from the description of a preferred embodiment thereof given hereinafter by way of non-limiting example with reference to the accompanying drawing, in which.

DETAILED DESCRIPTION OF THE INVENTION

Figure 1:
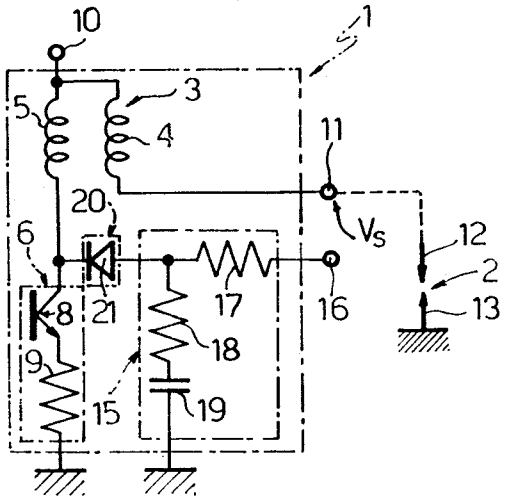
FIG. 1 is an electric schematic of an ignition device constructed in accordance with the present invention.

In FIG. 1, the reference numeral 1 indicates overall an inductive-discharge ignition device for spark plugs 2 of an internal combustion engine (not shown).

The device 1 is of the type comprising for each spark plug 2 a transformer 3 with a secondary winding 4 to be connected to the respective spark plug 2 and a primary winding 5 connected to the output of a power stage 6 of conventional type able to provide an ON-OFF signal for controlling the transformer 3.

Specifically, the stage 6 has an output section consisting of an N-P-N power transistor in Darlington connection, not shown. The transistor 8 has its emitter connected to earth via a resistor 9 and its collector connected to one end of the primary winding 5. This latter has its other end connected to a terminal 10 to which, when in use, the positive pole of a direct current power source (such as an accumulator battery) is connected. One end of the winding 4 is also connected to the terminal 10 and its other end is connected to a terminal 11. When in use, this latter terminal is connected to the electrode 12 of the spark plug 2, its body 13 being connected to earth.

According to the present invention the device 1 comprises a damping network 15 and unidirectional connection 20 means interposed between the network 15 and the output of the power stage 6, said means 20 connecting said network 15 to the output of the stage 6 each time the signal present at said output passes from an OFF condition to an ON condition.

Figure 2A:
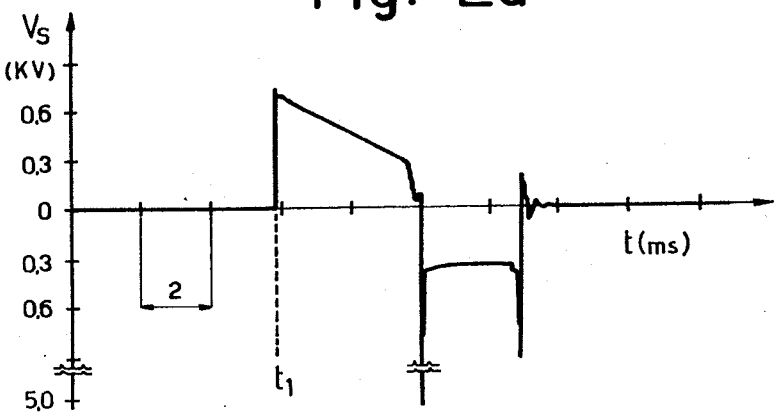
FIGS. 2*a* and 2*b* show the pattern of an electrical signal taken from a predetermined point of FIG. 1.
Figure 2B:
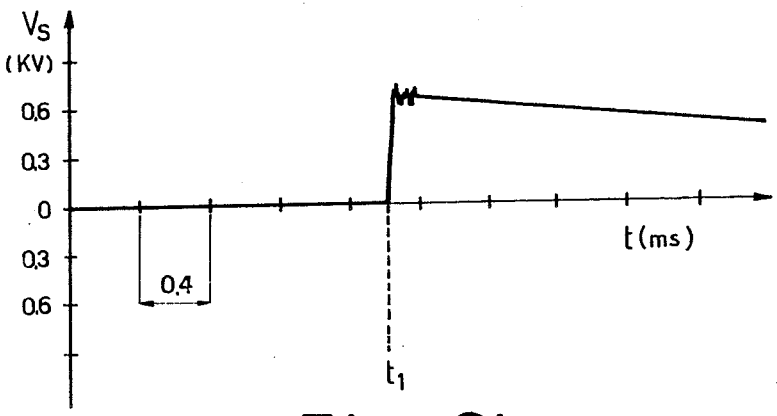

Specifically, the damping network 15, extending between a terminal 16 (also connected to said power source) and earth, comprises a first resistor 17, a second resistor 18 and a capacitor 19. A joining point between the resistors 17 and 18 is connected to the anode of a diode 21 (constituting said unidirectional connection means 20), the cathode of which is connected to a joining point between the output of the power stage 6 and the primary winding 5. The operation of the device 1 is described hereinafter with reference also to FIG. 2, which shows the pattern of the voltage signal taken at the terminal 11, ie at the exit of the secondary winding 4 of the transformer 3.

Specifically, during the time in which the transistor 8 is inhibited (OFF), the output signal of the stage 6 coincides substantially with the battery voltage at the terminal 10. During this time period the capacitor 19 charges through the resistors 17 and 18 to the value of the battery voltage present at the terminal 16.

When the transistor switches from inhibited (OFF) to conducting (ON) (time t1 of FIG. 2), the output signal of the power stage 6 passes from the battery voltage to almost zero (sum of the saturation voltage of the transistor 8 and the voltage drop across the resistor 9) slowly because of the presence of the capacitor 19. This is because under such conditions the diode 21 is directly biased so that the voltage across the power stage 6 decays substantially exponentially with a time constant equal approximately to the product of the capacitance of the capacitor 19 and the sum of the resistance of the resistor 18 and the internal resistance of the transistor 8, which operates in a linear zone almost until the capacitor 19 is completely discharged. The resistance of the resistor is considered negligible.

It is apparent that the charge time constant, determined by the product of the capacitance of the capacitor 19 and the sum of the resistances of the resistors 17 and 18 must be such as to allow the capacitor 19 to be recharged during the non-conducting (OFF) phase of the stage 6 when the engine is at maximum r.p.m. Indicatively, the value of this time constant could be between 2 ms and 3 ms.

Because of the fact that the ON-OFF switching is not sudden, the voltage Vs induced in the secondary winding 4 of the transformer 3 no longer has the said superimposed oscillating signal which is the source of the drawbacks of known devices. In this respect, from the pattern of the signal Vs shown in FIG. *2a* (one unit of the time scale equals 0.4 ms), it can be seen that the only substantial component of Vs is the induced voltage (of the order of about 0.6 kV). In contrast there is no longer any appreciable component of the said oscillating signal, which usually raises the value of Vs in known devices to as high as about 1.3 kV, to cause undesirable advance triggering of the arc in the spark plug.

The damping network 15 does not act during the ON-OFF switching of the output signal of stage 6 because under these conditions the diode 21 is inversely biased. Consequently, this switching can take place as rapidly as possible to enable an extremely high voltage to be induced in the secondary winding 4 (up to more than 15 kV) to cause very efficient triggering of the arc in the spark plug 2.

The advantages of the device of the present invention are apparent from an examination of its characteristics.

Firstly, said oscillating signal is prevented from arising in the secondary winding during the ON-OFF transition of the power stage. In addition, particularly costly components are not required as the range of voltages within which they have to operate is very limited and moreover the respective nominal ratings do not have to be particularly precise.

Finally, it is apparent that modifications can be made to the described device 1 provided they do not leave the scope of the invention.

For example, the resistor 18, which could be of the order of 1 ohm, is not strictly necessary. Its only purpose is to limit the initial current peak which the capacitor 19 discharges across the transistor 8 of the stage 6, to thus prevent undue damage to the transistor itself. If the stage 6 is protected so as to limit the charge current of the primary winding 5, the resistor 18 could be omitted. In addition, this resistor could be connected in series with the diode 12 instead of in series with the capacitor 19.

We claim:

1. An inductive-discharge ignition device for an internal combustion engine, comprising:

(a) a transformer for each spark plug, said transformer having a secondary winding and a primary winding;

(b) said secondary winding being connected to a respective spark plug;

(c) a power stage for providing an on-off signal for controlling said transformer;

(d) said primary winding being connected to an output of said power stage;

(e) a damping network; and (f) a unidirectional connection means, interposed between said network and the output of said power stage, for connecting said network to the output of said power stage each time the signal present at the output of said power stage switches from an off condition to an on condition.

2. A device as in claim 1, wherein said damping network comprises:

(a) at least one capacitor; and (b) means for charging said capacitor.

3. A device as in claim 2, wherein:

(a) said charging means comprises at least one resistor connected to said capacitor and said resitor connected to a direct current power supply.

4. A device as in claim 3, wherein:

(a) said capacitor and said resistor define a charge constant having a value substantially less than one of the time periods between two consecutive on conditions and two consecutive off conditions.

5. A device as in claim 4, wherein:

(a) said time constant is of the order of at least one millisecond.

6. A device as in claim 2, and further comprising:

(a) a resistor connected in series with said capacitor.

7. A device as in claim 2, and further comprising:

(a) a resistor connected in series with said unidirectional connection means.

8. A device as in claim 2, wherein:

(a) said unidirectional connection means includes means for permitting said capacitor to discharge across said power stage each time the signal present at the output of said power stage switches from the off condition to the on condition.

9. A device as in claim 1, wherein:

(a) said unidirectional connection means includes a diode having its anode connected to said damping network and its cathode connected to the output of said power stage.

* * * * *